United States Patent [19]

Zelahy et al.

[11] 4,148,494

[45] Apr. 10, 1979

[54] ROTARY LABYRINTH SEAL MEMBER

[75] Inventors: John W. Zelahy, West Chester; Norman P. Fairbanks; Robert E. Maegly, both of Cincinnati, all of Ohio

[73] Assignee: General Electric Company, Cincinnati, Ohio

[21] Appl. No.: 862,783

[22] Filed: Dec. 21, 1977

[51] Int. Cl.[2] ..... F01D 11/08; F01D 5/20; F16J 15/44

[52] U.S. Cl. ..... 277/53; 277/DIG. 6; 415/172 A; 415/174; 428/559; 75/244

[58] Field of Search ..... 277/53-57, 277/96.2, 235 A, 235 R, 236, 224, DIG. 6; 415/172 R, 172 A, 170 R, 174; 75/244, 254; 428/553, 559

[56] References Cited

U.S. PATENT DOCUMENTS

| | | | |
|---|---|---|---|
| 2,839,413 | 6/1958 | Taylor | 75/244 X |
| 3,068,016 | 12/1962 | Dega | 75/244 X |
| 3,339,933 | 9/1967 | Foster | 277/53 |
| 3,421,862 | 1/1969 | Shyne et al. | 75/244 X |
| 3,481,715 | 12/1969 | Whalen et al. | 277/235 A X |
| 3,537,713 | 11/1970 | Matthews et al. | 277/55 |
| 3,846,899 | 11/1974 | Gross | 277/53 X |
| 3,964,877 | 6/1976 | Bessen et al. | 415/174 X |
| 3,975,165 | 8/1976 | Elbert et al. | 415/174 X |

FOREIGN PATENT DOCUMENTS

| | | | |
|---|---|---|---|
| 2344666 | 3/1974 | Fed. Rep. of Germany | 277/53 |
| 236207 | 4/1926 | United Kingdom | 415/170 R |

*Primary Examiner*—Robert S. Ward, Jr.
*Attorney, Agent, or Firm*—Lee H. Sachs; Derek P. Lawrence

[57] ABSTRACT

A rotary labyrinth gas seal between a rotating member and a stationary member, one of which includes at least one seal tooth projecting toward a surface of the other member is improved through the provision of an abrasive tip on the projecting tooth. Such abrasive tip comprises an electrodeposited metal matrix which entraps a plurality of abrasive particles protruding from the tip, the thickness of the matrix being less than the longest dimension of the abrasive particles protruding from the tip.

4 Claims, 2 Drawing Figures

ROTARY LABYRINTH SEAL MEMBER

FIELD OF THE INVENTION

This invention relates to gas seals between stationary and movable members, such as rotary seals in gas turbine engines and, more particularly, it relates to the labyrinth-type of seal.

CROSS REFERENCE TO RELATED APPLICATIONS

This application relates to copending and concurrently filed application Ser. No. 863,017, filed Dec. 21, 1977 entitled "Improved Gas Seal and Method for Making".

BACKGROUND OF THE INVENTION

Frequently used in gas turbine engines is a variety of rotary seals which includes rotating members cooperating across a narrow gap with another member which is generally stationary. For example, such seals are used between stationary structural members and a rotating shaft or drum for the purpose of maintaining different pressures in chambers adjacent the seal. As described in U.S. Pat. No. 3,339,933 - Foster, issued Sept. 5, 1967, and elsewhere in the art, common rotary labyrinth-type seals are coated with plasma arc sprayed materials such as high temperature oxides, for example alumina. However, plasma sprayed alumina has been seen to spall during gas turbine engine operation because of thermal cycling or gas erosion or their combinations.

SUMMARY OF THE INVENTION

It is an object of the present invention to provide an improved rotary labyrinth seal member with an abrasive tip which resists spalling during operation.

This and other objects and advantages will be more fully understood from the following detailed description and the drawing, all of which are intended to be representative of rather than in any way limiting on the scope of the present invention.

One form of the present invention provides a rotary labyrinth gas seal in which a first member includes at least one seal tooth having a tip which cooperates with a second member to inhibit gas flow therebetween. The tip includes a metallic body and an abrasive tip portion comprising an electrodeposited metal matrix which entraps a plurality of abrasive particles protruding from the tip. The particles have a hardness greater than the thickness of the second member; the thickness of the matrix is less than the longest dimension of the abrasive particles in the direction in which they protrude from the tip.

DESCRIPTION OF THE PREFERRED EMBODIMENTS

The modern gas turbine engine, for example the type used in aircraft, includes a variety of labyrinth-type rotary seals. In such seals, at least one tooth or projection, and generally a plurality of teeth or projections, cooperates with an opposed surface which can be continuous or can be a porous or open-celled structure such as honeycomb. Thus, various chambers at different pressures are isolated within the engine. In some cases, the tooth projections rotate with rotating engine components; in other cases the opposed surface, such as a shaft, rotates in respect to stationary toothed members. Because various components of a gas turbine engine associated with the cooperating seal members tend to expand at different rates, provision must be made for interference between such seal members. In some examples, such as that shown in the above-identified Foster patent, the surface opposed to the projection or tooth is treated with an abrasive which will grind away the interfering projection. In other cases, the projection is provided with an abrasive tip coating through thermal deposition such as torch spraying of an oxide such as alumina. However, because of the difference in expansion rates between the metal body of the tooth and the oxide abrasive tip, spalling has been observed.

Figure 1:
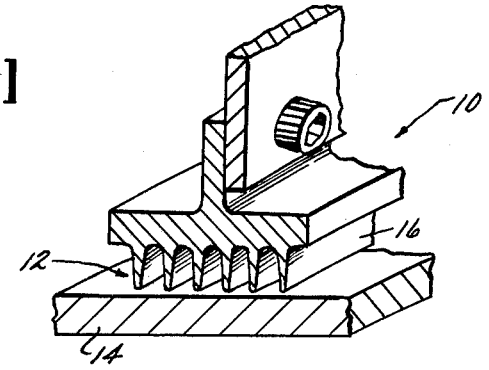
FIG. 1 is a fragmentary, perspective, sectional view of a labyrinth-type rotary seal including rotating teeth cooperating with a stationary opposed member surface.
Figure 2:
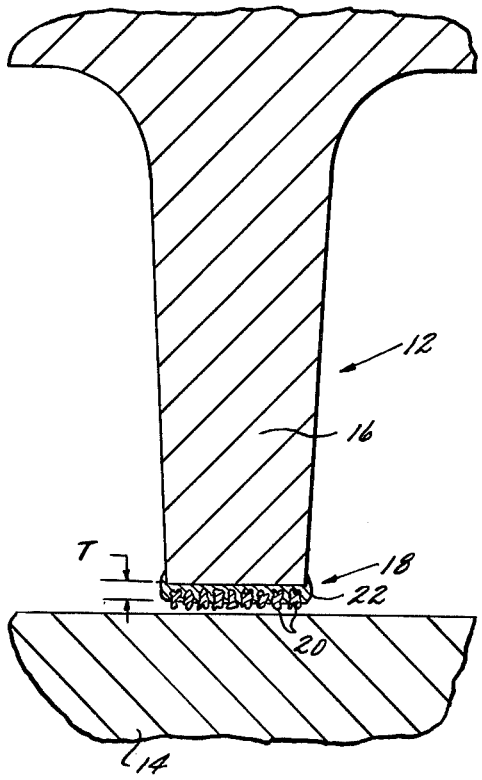
FIG. 2 is an enlarged, sectional view of one of the tooth projections of FIG. 1.

One form of the present invention provides an improved tip for the tooth or projection of a labyrinth-type gas seal in the form of a metal bonded tip portion in which is embedded abrasive particles protruding from the metal matrix. With reference to the drawing, FIG. 1 shows in fragmentary, perspective cross section, one type of rotary labyrinth seal in which rotating member 10, including a plurality of teeth 12, cooperates with stationary member 14 to provide a labyrinth seal of a type used in gas turbine engines. FIG. 2 is an enlarged sectional view of one tooth of FIG. 1, in accordance with the present invention.

In FIG. 2, tooth 12 includes a body 16 and an abrasive tip 18 comprised of a plurality of abrasive particles 20, preferably cubic boron nitride, commercially available as Borazon material, entrapped in a metal matrix 22. The radial thickness T of the matrix, as shown in FIG. 2, is less than the longest dimension of the abrasive particles in the direction of their protrusion from the matrix so that the matrix does not completely encapsulate all such particles.

Metal matrix 22 preferably is an electrodeposited metal, such as nickel, or an alloy including nickel, electroplated onto body 16 of tooth 12. It has been found desirable to deposit abrasive particles 20 and metal matrix 22 concurrently on body 16 electrolytically from an electrodeposition bath in which are suspended abrasive particles 20. Such particles can be of cubic boron nitride or other abrasive particles, for example silicides, oxides, nitrides or carbides, stable at the intended operating temperatures. Such codeposition of abrasive particles and metal electrolytically is commonly used commercially in the manufacture of metal bonded, abrasive metal removal tools such as grinding wheels and cutting tools.

Although the present invention has been described in connection with specific examples, it will be recognized by those skilled in the art the variations and modifications of which this invention is capable within the scope of the appended claims.

What is claimed is:

1. In a rotary labyrinth gas seal in which a first member includes at least one seal tooth having a tip which cooperates with a second member to inhibit gas flow therebetween, the tip comprising a metallic body and an abrasive tip, the improvement wherein:

the abrasive tip comprises an electrodeposited metal matrix entrapping a plurality of abrasive particles protruding from the tip, the particles having a hardness greater than the hardness of the second member, the thickness of the matrix being less than the longest dimension of the abrasive particles protruding from the tip.

2. The seal of claim 1 in which the metal matrix is selected from the group consisting of nickel and alloys including nickel.

3. The seal of claim 1 in which the abrasive particles are a nonmetallic material selected from the group consisting of silicides, oxides, borides, nitrides and carbides, stable at an intended operating temperature.

4. The seal of claim 3 in which the abrasive particles are cubic boron nitride material.

* * * * *